US009397455B2

(12) United States Patent
Fontaine et al.

(10) Patent No.: US 9,397,455 B2
(45) Date of Patent: Jul. 19, 2016

(54) COUPLER CONNECTOR AND CABLE TERMINATOR WITH SIDE CONTACTS

(71) Applicant: BELDEN CANADA INC., Saint-Laurent (CA)

(72) Inventors: Marc Fontaine, Les Cedres (CA); Jean-Sebastien Plamondon, Laval (CA); Virak Siev, Montreal (CA); Alain Desroches, Les Cedres (CA); Luc Milette, Montreal (CA); Francois Beauregard, La Prairie (CA)

(73) Assignee: BELDEN CANADA INC., Saint-Laurent (CA)

( * ) Notice: Subject to any disclaimer, the term of this patent is extended or adjusted under 35 U.S.C. 154(b) by 0 days.

(21) Appl. No.: 14/845,601

(22) Filed: Sep. 4, 2015

(65) Prior Publication Data

US 2016/0072240 A1 Mar. 10, 2016

Related U.S. Application Data

(60) Provisional application No. 62/045,664, filed on Sep. 4, 2014.

(51) Int. Cl.

| | |
|---|---|
| ***H01R 24/00*** | (2011.01) |
| ***H01R 24/64*** | (2011.01) |
| ***H01R 4/24*** | (2006.01) |
| ***H01R 43/01*** | (2006.01) |
| *H01R 107/00* | (2006.01) |

(52) U.S. Cl.

CPC ..... *H01R 24/64* (2013.01); *H01R 4/2404* (2013.01); *H01R 43/01* (2013.01); *H01R 2107/00* (2013.01)

(58) Field of Classification Search

CPC ..... H01R 13/6466; H01R 24/62; H01R 24/64

USPC ..... 439/676, 418, 404

See application file for complete search history.

(56) References Cited

U.S. PATENT DOCUMENTS

| | | | | |
|---|---|---|---|---|
| 6,371,793 | B1 | 4/2002 | Doorhy et al. | |
| 7,252,554 | B2 | 8/2007 | Caveney et al. | |
| 7,670,193 | B2 * | 3/2010 | Milette | H01R 24/64 439/676 |
| 7,823,281 | B2 * | 11/2010 | Caveney | H05K 1/0228 29/827 |
| 8,826,532 | B2 * | 9/2014 | Caveney | H05K 1/0228 29/842 |

FOREIGN PATENT DOCUMENTS

| | | | |
|---|---|---|---|
| CA | 2468007 | A1 | 11/2004 |
| CA | 2694884 | A1 | 2/2009 |

OTHER PUBLICATIONS

International Search Report of corresponding PCT application No. PCT/CA2015/050850.

* cited by examiner

*Primary Examiner* — Phuong Dinh

(74) *Attorney, Agent, or Firm* — Goudreau Gage Dubuc; Hugh Mansfield

(57) ABSTRACT

An assembly comprising a cable terminator comprising a wire guide, a cube shaped securing cap comprising an open end for installation over the wire guide, and pairs of piercing contacts for piercing respective conductors of the cable. When assembled, an outer end of each of the piercing contacts is exposed on an outer surface of a respective securing cap sidewall. The assembly also comprises a coupler connector comprising one of a modular (for example RJ-45 compatible) socket or a modular (for example RJ-45 compatible) plug, a rearward surface comprising a cable terminator receiving socket, wherein pairs of contacts are exposed along at least one side wall of the socket, and further wherein each of a plurality of the tines in the modular socket or the terminal contacts of the plug is interconnected with a respective one of the contacts. When the cable terminator is inserted into the cable terminator receiving socket, each of the piercing contacts comes into contact with a respective one of the contacts, thereby interconnecting each of the tines (or each of the terminal contacts) with a respective one of the conductors. A back-to-back connector is also disclosed.

14 Claims, 15 Drawing Sheets

COUPLER CONNECTOR AND CABLE TERMINATOR WITH SIDE CONTACTS

CROSS REFERENCE TO RELATED APPLICATIONS

This application claims benefit, under 35 U.S.C. §119(e) of U.S. provisional application Ser. No. 62/045,664, filed on Sep. 4, 2014 which is incorporated herein in its entirety by reference.

FIELD OF THE INVENTION

The present invention relates to a coupler connector and cable terminator with side contacts. In particular, the present invention relates to a connector for simplifying the installation of a modular receptacle or plug to the end of a cable comprising a plurality of twisted pairs of conductors.

BACKGROUND TO THE INVENTION

The prior art discloses a variety of assemblies for terminating communications cables in the field. One drawback of such prior art assemblies is that they typically require the individual conductors of the communications cable to be threaded or fished through a small opening prior to being pierced by an insulation displacement connector or the like to provide conductive contact. As a result, such prior art assemblies require skill and/or time to assemble and therefore are inefficient and cumbersome. Additionally, the mechanical strength of such prior art assemblies is limited thereby allowing the assembly to be inadvertently disassembled, for example through forceful tugging on the cable or the like.

SUMMARY OF THE INVENTION

In order to address the above and other drawbacks, there is provided an assembly for terminating a cable comprising a four pairs of conductors. The assembly comprises a cable terminator comprising a wire guide comprising two opposite outer sides and four elongate parallel conductor pair receiving slots, two of the slots exposed side by side on each of the two opposite outer sides, each of the slots for receiving a respective conductor pair, a securing cap comprising an open end sized for snug installation at least partially over the wire guide opposite outer sides, a pair of opposed sidewalls each comprising two pairs of piercing contact receiving slots therein, and four pairs of piercing contacts, each of the pairs of piercing contacts insertable into a respective pair of the piercing contact receiving slots, wherein when assembled each of the opposed sidewalls is positioned adjacent a respective one of the opposite outer sides such that a piercing end of each of the piercing contacts is positioned opposite a respective one of the conductors and in contact with the respective conductor and an outer end of each of the piercing contacts is exposed on an outer surface of a respective securing cap sidewall, and a coupler connector comprising a rearward surface comprising a cable terminator receiving socket disposed therein wherein four pairs of socket contacts are exposed along at least one side wall of the socket and a forward surface comprising one of a modular socket disposed therein, wherein a plurality of tines are exposed within the modular socket wherein each of the is interconnected with a respective one of the socket contacts and a plug disposed thereon, wherein a plurality of terminal contacts are exposed along a forward edge of the plug and each of the terminal contacts is interconnected with a respective one of the socket contacts. When the cable terminator is inserted into the cable terminator receiving socket, each of the piercing contacts comes into contact with a respective one of the socket contacts, thereby interconnecting each of the tines with a respective one of the conductors.

Additionally, there is provided a back-to-back connector assembly for interconnecting a first multi conductor cable with a second multi conductor cable. The assembly comprises a pair of cable terminators for terminating respective ones of the cables, one of the each of the cable terminators comprising: a wire guide comprising two opposite outer sides and four elongate parallel conductor pair receiving slots, two of the slots exposed side by side on each of the two opposite outer sides, each of the slots for receiving a respective conductor pair, a securing cap comprising an open end sized for snug installation at least partially over the wire guide opposite outer sides, a pair of opposed sidewalls each comprising two pairs of piercing contact receiving slots therein, and four pairs of piercing contacts, each of the pairs of piercing contacts insertable into a respective pair of the piercing contact receiving slots, wherein when assembled each of the opposed sidewalls is positioned adjacent a respective one of the opposite outer sides such that a piercing end of each of the piercing contacts is positioned opposite a respective one of the conductors and in contact with the respective conductor and an outer end of each of the piercing contacts is exposed on an outer surface of a respective securing cap sidewall, and a coupler connector comprising a rearward surface comprising a first cable terminator receiving socket disposed therein wherein a first plurality of pairs of socket contacts are exposed along at least one side wall of the first socket and a forward surface comprising a second cable terminator receiving socket disposed therein wherein a second plurality of pairs of socket contacts are exposed along at least one side wall of the second, and further wherein each of the first plurality of socket contacts is interconnected with a respective one of the second plurality of socket contacts. When the cable terminators are inserted into their respective cable terminator receiving sockets, each of the piercing contacts comes into contact with a respective one of the socket contacts, thereby interconnecting the first multi-conductor cable with the second multi-conductor cable.

There is also provided a method for terminating a cable comprising a jacket surrounding a plurality of twisted pairs of conductors. The method comprises stripping a length of the jacket from an end of the cable to expose a free end of each of the pairs of conductors, feeding the free ends though the middle of a wire guide in a first direction untwisting at least a portion of the free ends, bending each the untwisted free ends over the wire guide into a respective receiving slot and in a direction opposite the first direction wherein the untwisted free end of the first pair and second pair of the conductors are exposed along a first side of the wire guide and the untwisted free end of the third pair and fourth pair of the conductors is exposed along a second side of the wire guide opposite the first side, inserting the wire guide into an open end of a securing cap comprising a plurality of pairs of piercing contacts arranged along opposite sides thereof, wherein when the securing cap is installed on the wire guide, each of the pairs of piercing contacts align with a respective pair of conductors, piercing an insulation of each of the conductors with a piercing first end of an aligned one of the piercing contacts wherein a contacting second end of each of the piercing contacts remains exposed on an outer surface of the cap, inserting the cap and the wire guide into a cap and wire guide receiving socket in rearward surface of a coupler connector such that each of the contacting second ends of the piercing contacts comes into contact with a respective one of eight socket contacts exposed on an inside wall of the cap and wire guide receiving socket, the coupler connector further comprising a forward surface comprising one of a modular socket and disposed therein, wherein a plurality of tines are exposed within the modular socket and each of the tines is interconnected with a respective one of the socket contacts and a modular plug disposed thereon, wherein a plurality of terminal contacts are exposed along a forward edge of the plug and each of the terminal contacts is interconnected with a respective one of the socket contacts.

DETAILED DESCRIPTION OF THE ILLUSTRATIVE EMBODIMENTS

Figure 1:
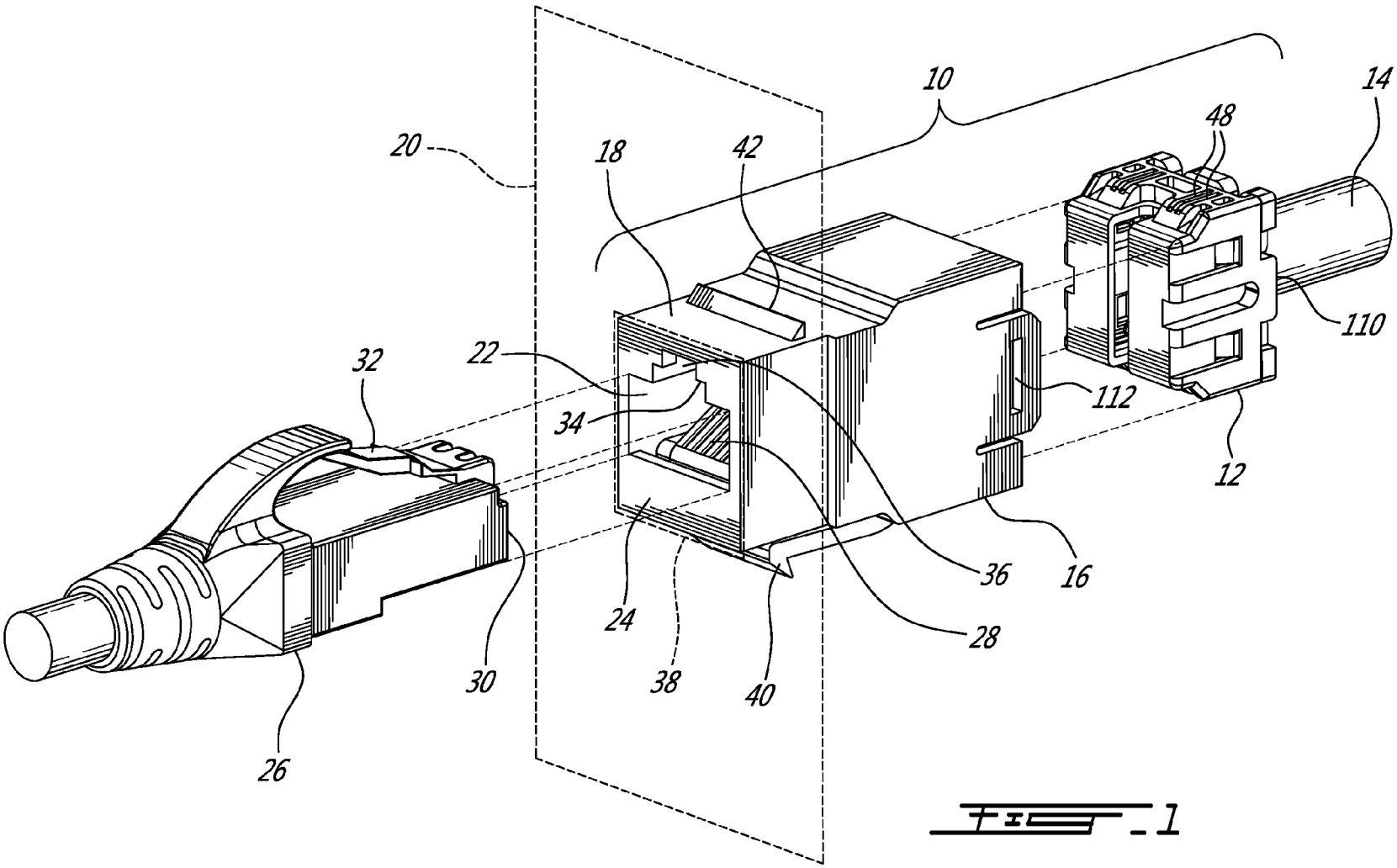
FIG. 1 provides an isometric view of a plug, coupler connector and cable terminator in accordance with an illustrative embodiment of the present invention.

Referring now to FIG. 1, a coupler connector and cable terminator, generally referred to using the reference numeral 10, will now be described. The coupler connector and cable terminator comprises a cable terminator 12 which terminates a cable 14 comprising a plurality of pairs of conductors (not shown) which is inserted into a coupler connector 16. The coupler connector 16 illustratively comprises a keystone compatible type outer housing 18 rendering it suitable for insertion into a keystone compatible wall plate 20 or patch panel (not shown). The coupler comprises 16 further comprises a modular socket 22, illustratively an RJ-45 compatible socket, in a forward end 24 thereof for receiving a compatible plug 26 therein. A plurality of contact strips 28, or tines, are secured within the socket 22.

Still referring to FIG. 1, the plug 26 terminates a second cable 30 comprising a plurality of pairs of conductors (not shown). The plug 26 further comprises a plurality terminal contacts (not shown) along a forward edge 30 thereof which are interconnected with respective conductors of the second cable 28. When the plug is inserted into the socket 22, the terminal contacts come into contact with respective ones of the contact strips 28. The plug 26 further comprises a locking latch 32 which, when inserted into the socket 22, is received within a recess 34 and engages a shoulder 36 thereby retaining the plug 26 within the socket 22.

Still referring to FIG. 1, the coupler connector 16 is retained within a mounting opening 38 in the wall plate 20 by a cantilevered latch 40 in conjunction with a raised rib 42 which engage respective recesses (not shown) in the wall plate 20.

Figure 2:
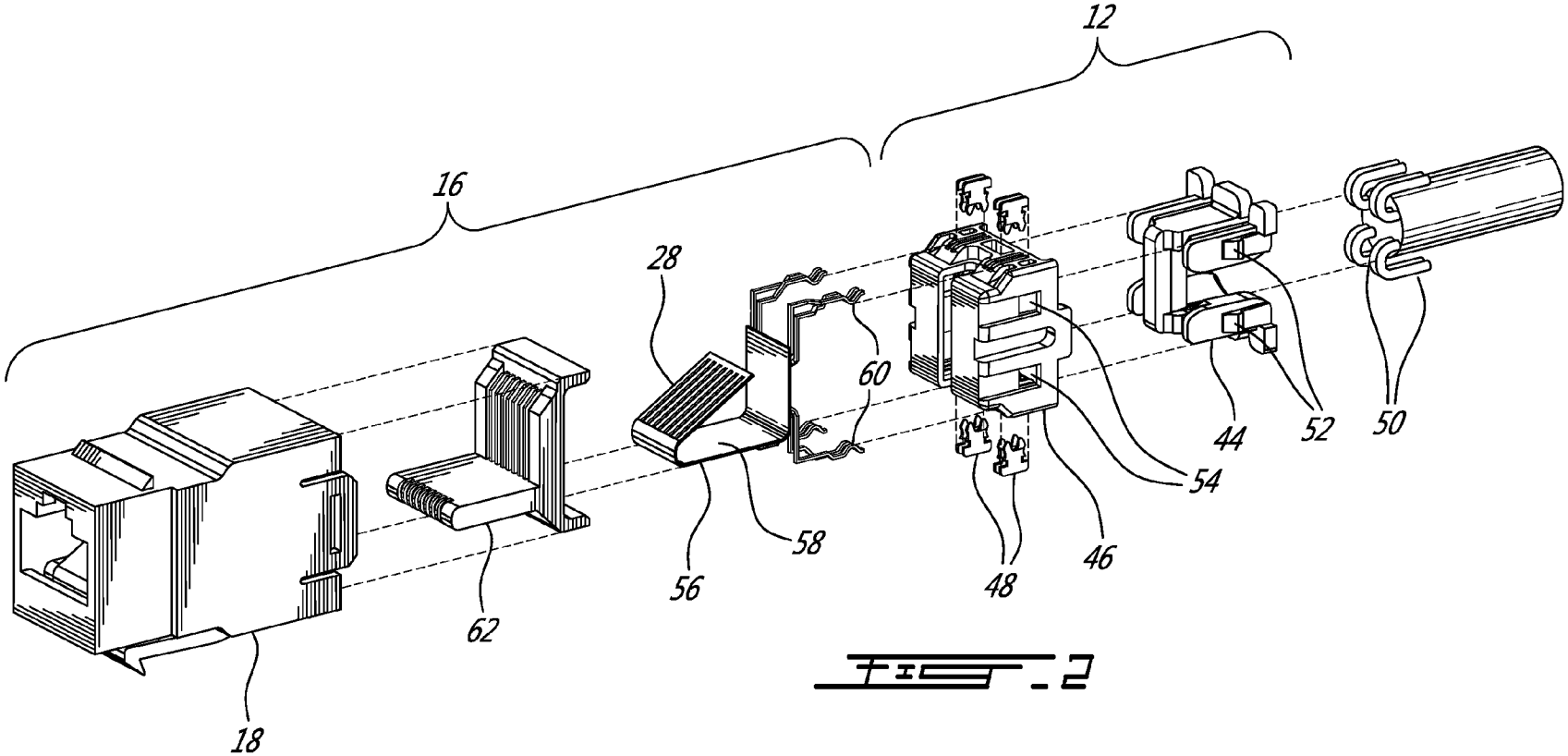
FIG. 2 provides an exploded view of a coupler connector and cable terminator in accordance with an illustrative embodiment of the present invention.

Referring now to FIG. 2, the cable terminator 12 comprises a wire guide 44, cap 46 and a plurality of piercing contacts 48. During assembly, and as will be discussed in more detail below, the pairs of conductors 50 of the cable 14 are first assembled to the wire guide 44, the cap 46 placed over the wire guide 44 wherein raised ribs 52 on the wire guide 44 are engaged in respective complementary recesses 54 machined or otherwise moulded into the cap 46, thereby securely retaining the cap 46 against the wire guide 44.

Still referring to FIG. 2, as discussed above the coupler connector 16 comprises an outer housing 18 which receives an interconnection assembly 56 comprising a flexible printed circuit board 58 onto which the plurality of contact strips 28 are etched, a plurality of contact springs 60 and a support 62.

Figure 3C:
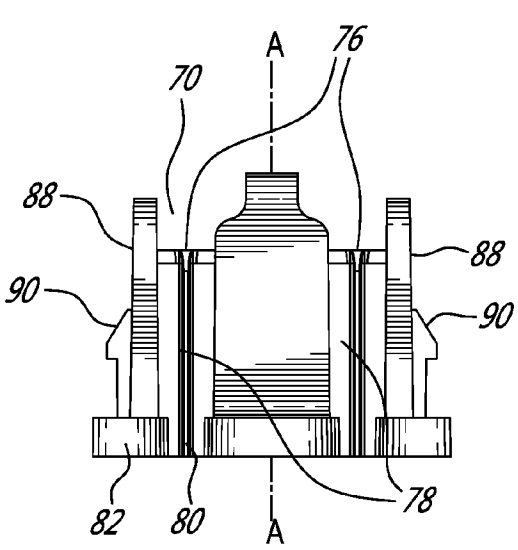
FIGS. 3A through 3C provide respectively perspective, top plan and side plan views of a wire guide in accordance with an illustrative embodiment of the present invention.
Figure 3B:
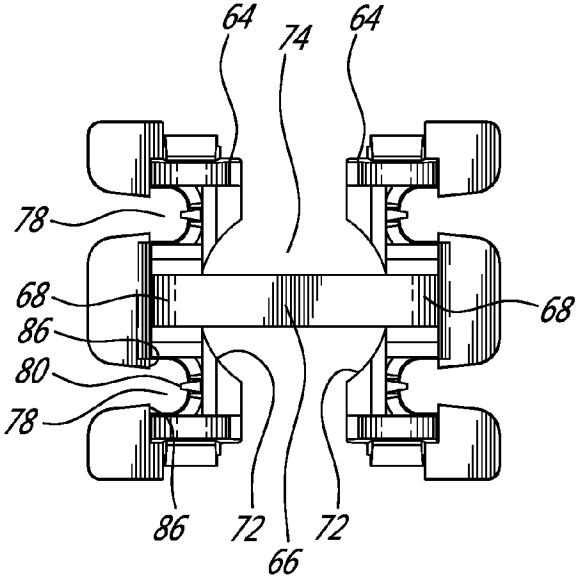
Figure 3A:
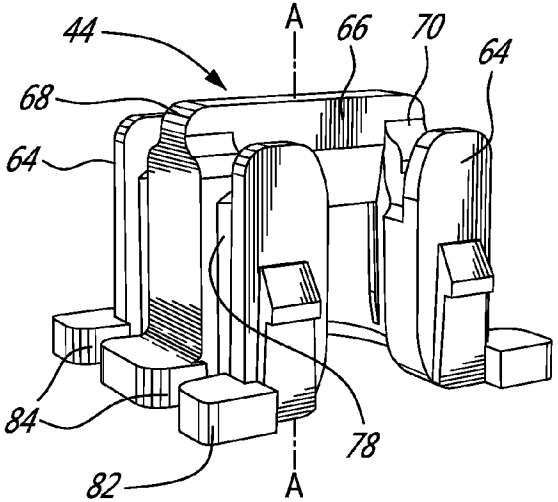

Referring now to FIGS. 3A, 3B and 3C, the wire guide 44 is fabricated from moulded plastic or the like and comprises a pair of opposed plates 64 arranged on either side of an axis A. The plates are interconnected by an elongate joining member 66 which attaches at either ends 68 to each of the plates 64 towards the middle of a forward edge 70 thereof. Referring to FIG. 3B in particular, the plates 64 each comprise arcuate inner surfaces 72 which define a substantially cylindrical cable receiving region 74 there between, and concentric with the axis A. The plates 64 are able to flex slightly about their points of attachment to the elongate joining member 66 and such that they can be flexed inwards to grip a cable positioned within the cylindrical cable receiving region 74. Each forward edge 70 comprises a pair of notches 76 arranged on either side of the point of attachment of the elongate joining member 66. Each plate 64 further comprises a pair of slots 78 on an outer surface thereof, arranged in parallel to the axis A and intersecting a respective one of the notches 76. Each of the slots 78 comprises a slot dividing ridge 80 which, as will be discussed in more detail below, serves to better retain the pair of conductors (not shown) within the slot 78. The lower edges of the plates 64 each comprise a cap receiving ledge 82 into which a pair of notches 84 are machined or otherwise moulded. Each of the notches 84 are somewhat narrow than the slots 78 with which the intersect thereby providing a pair of opposed shoulders 86 in each notch 84 which serve to hold the conductor pair within their respective slots 78 during assembly. Additionally, the outer edges 88 of each plate 64 each comprise a raised tabs 90 which, as will be discussed in more detail below, engage respective recesses in the cap (reference 46 in FIG. 2) when it is installed on the wire guide 44.

Figure 4A:
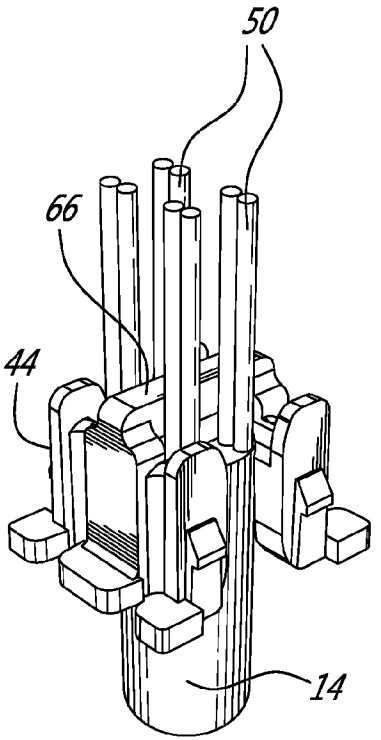
FIGS. 4A through 4C provide perspective views illustrating the installation of a cable on a wire guide and in accordance with an illustrative embodiment of the present invention.

Referring now to FIG. 4A in addition to FIGS. 3A through 3C, during assembly the end of the cable 14 is first stripped to remove the outer jacket and expose an end portion of the four pairs of conductors 50, which are typically twisted pairs of conductors. Each pair of conductors is straightened, the ends unwound and the wire guide 44 placed over the end of the stripped cable 14 with the end of the cable being received within the cable receiving 74 region between the opposed arcuate inner surfaces 72, with two pairs of conductors 50 arrange on either side of the elongate joining member 66. One advantage of the wire guide 44 is that the conductors 50 do not have to be fished or fed through a small aperture or hole or the like, which greatly simplifies the installation process.

Still referring to FIG. 4A, typically the wires 50 are colour coded and arranged according to a standard configuration. In a particular embodiment each of the slots is identified with a unique colour code (not shown) thereby providing a visual key to the installer and simplifying installation.

Figure 4B:
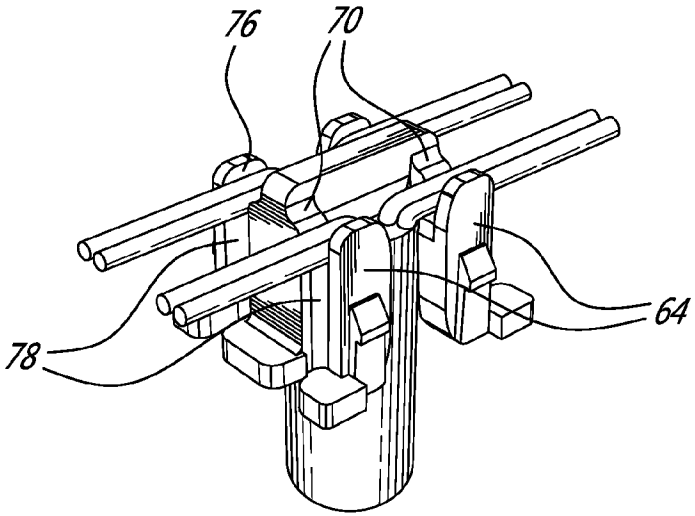
Figure 4C:
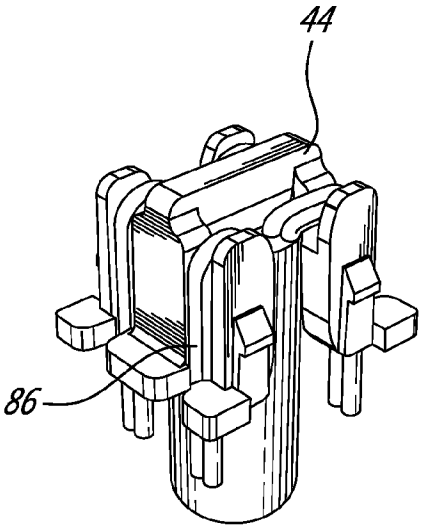

Referring to FIG. 4B, the conductors 50 are then bent snugly into their respective notches 76 over the forward edge 70 of the plate 64 and, with reference to FIG. 4C, the untwisted ends received into their respective slots 78 where they are secured by the shoulders 86 (FIG. 4C). One advantage of this configuration is that the strain relief is increased as the mechanical strength of the interconnection between the cable 14 and the wire guide 44 is relatively strong, thereby decreasing, for example, that the cable 14 is inadvertently removed from the wire guide 44, for example by tugging on the cable 16 when installed.

Figure 5C:
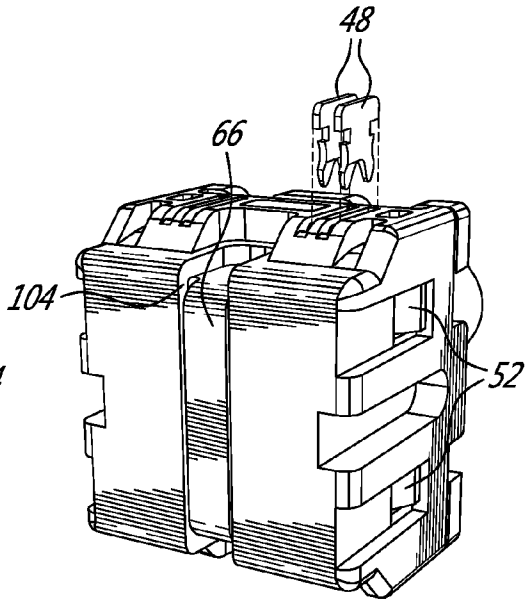
FIGS. 5A through 5C provide respectively isometric, bottom and a perspective view from the top of a cap in accordance with an illustrative embodiment of the present invention.
Figure 5B:
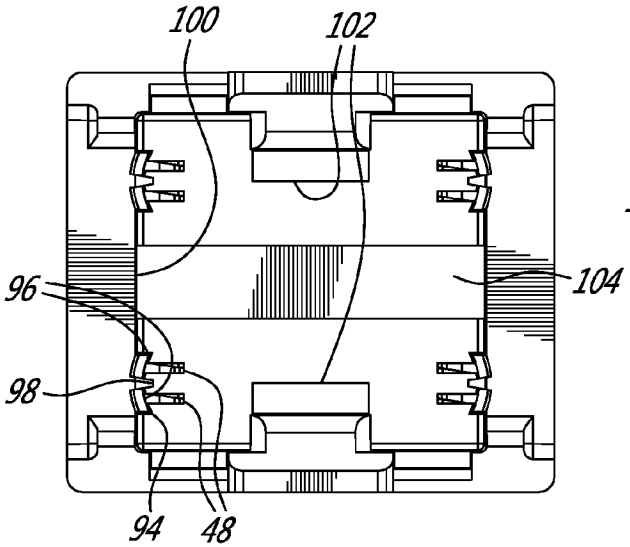
Figure 5A:
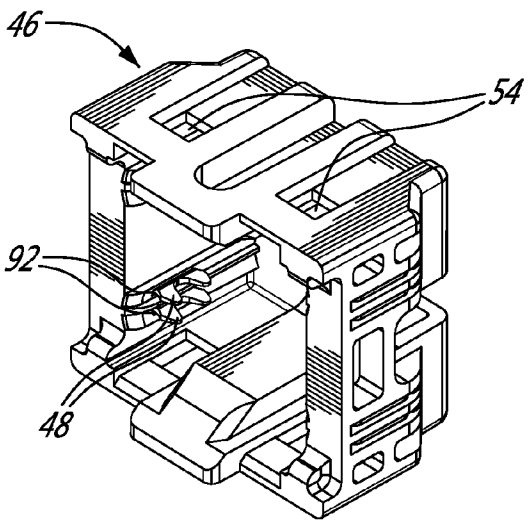

Referring now FIGS. 5A though 5C, the cap 46 is hollow and comprises four pairs of (8) slots 92 therein which receive the pairs of piercing contacts 48. Aligned with each of the pairs of slots 92 is a raised elongate boss 94 comprising a pair of surfaces 96 angled inwards and divided by a raised ridge 98. On insertion of the wire guide 44 into the cap 46, each raised elongate boss 94 aligns with its respective slot (reference 78 in FIG. 3A) and presses against the outside of the untwisted ends of their respective pair of conductors 50, ensuring that the untwisted ends are held securely and in parallel within their respective slots.

Still referring to FIGS. 5A through 5C a person of skill in the art will understand that the piercing contacts 48, though initially not extending past the inner surface 100 of the cap 46 prior to installation, are subsequently forced into their respective conductors 50 typically using a tool (not shown) once the cap 46 has been installed over the wire guide 44/cable 14 assembly. As discussed above, the cap 46 comprises recesses 54 which engage with complementary ribs 52 on the wire guide 44 for securing the cap 46 to the wire guide 44/cable 14 assembly. Additionally, guides 102 along the inside of the cap 46 are received between the ends of the opposed plates 64 of the wire guide 44, thereby closing the side access to the wire guide 44 and improving mechanical strength and stability of the assembly. Following installation of the cap 46 over the wire guide 44/cable 14 assembly and insertion of the piercing contacts 48 into their respective conductors 50, the outer edges of the piercing contacts 48 are flush with an outer surface of the cap 46 or slightly recessed within their respective slots 92.

Still referring to FIG. 5C, a slot 104 in the upper surface 106 of the cap 46 is provided such that when the cap 46 is assembled to the wire guide 44, the elongate joining member 66 is exposed along the upper surface 106. This provides, for example, that in a particular embodiment where the cable 14 is shielded, all or a portion of the wire guide 44 can be fabricated from a conductive material such as metal or the like and interconnected with a cable shield (not shown).

Figure 6A:
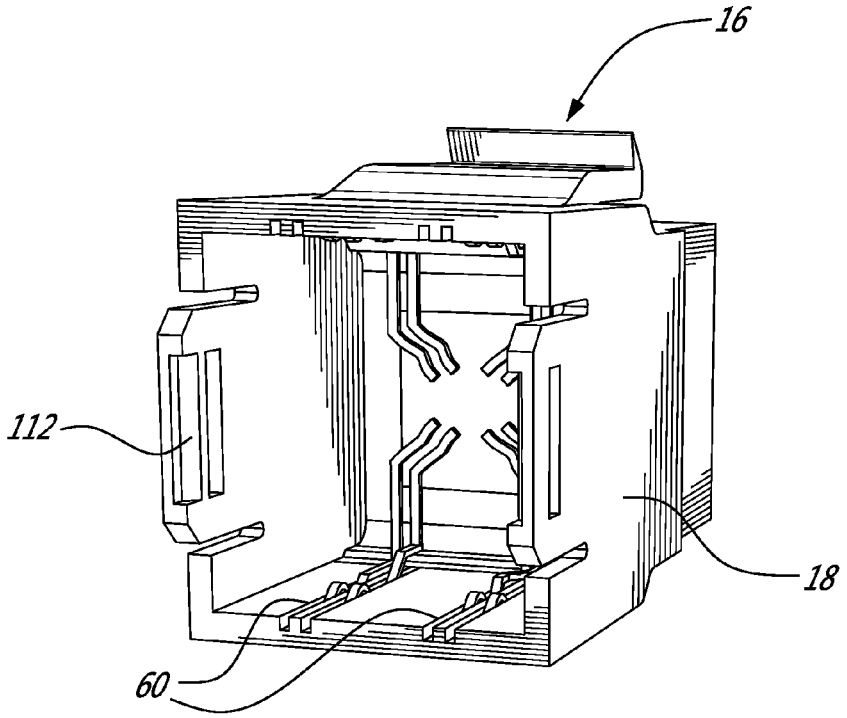
FIGS. 6A and 6B provide respectively a rear right perspective view and a sectional view of a coupler connector in accordance with an illustrative embodiment of the present invention.
Figure 6B:
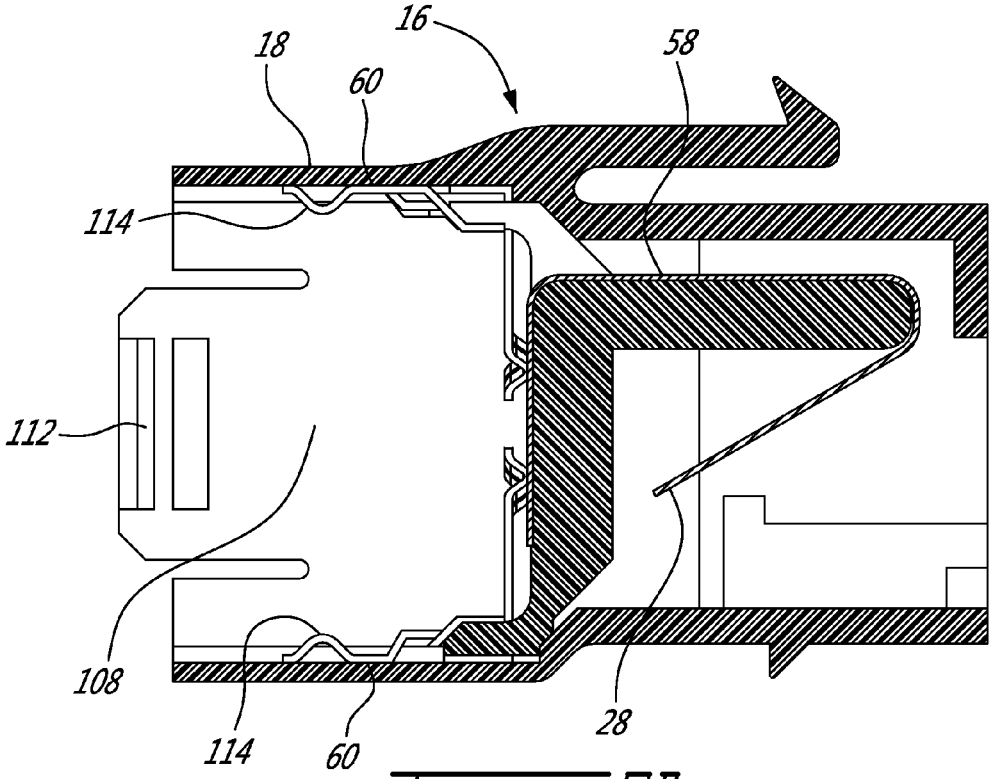

Referring now to FIGS. 6A and 6B, as discussed above the coupler connector 16 comprises a housing 18 and a plurality of contact springs 60 which are exposed on an inner surface 108 of the housing 18. Each of the contact springs is connected to a respective one of the tines 28, illustratively via a respective trace (not shown) on the flexible printed circuit board 58. Referring back to FIG. 1, the assembled cable terminator 12 is inserted into the inner surface 108 of the housing 18 until the lower edge 110 of the cable terminator 12 is engaged by respective locking ribs 112 moulded into the housing. In this position, each of the contact springs 60 comes into contact with a respective one of the piercing contacts 48 which, as discussed above, are in contact with respective ones of the conductors 50. In this regard, and with reference to FIG. 5A in addition to FIGS. 6A and 6B, each of the contact springs 60 comprises a piercing contact engaging portion 114 which engages an outer surface of a respective piercing contact 48 and, in the event as discussed above the outer surface of the piercing contact 48 is recessed within its respective slot 92, penetrates slightly into the slot 92 to ensure good electrical contact with the piercing contact 48.

Figure 7:
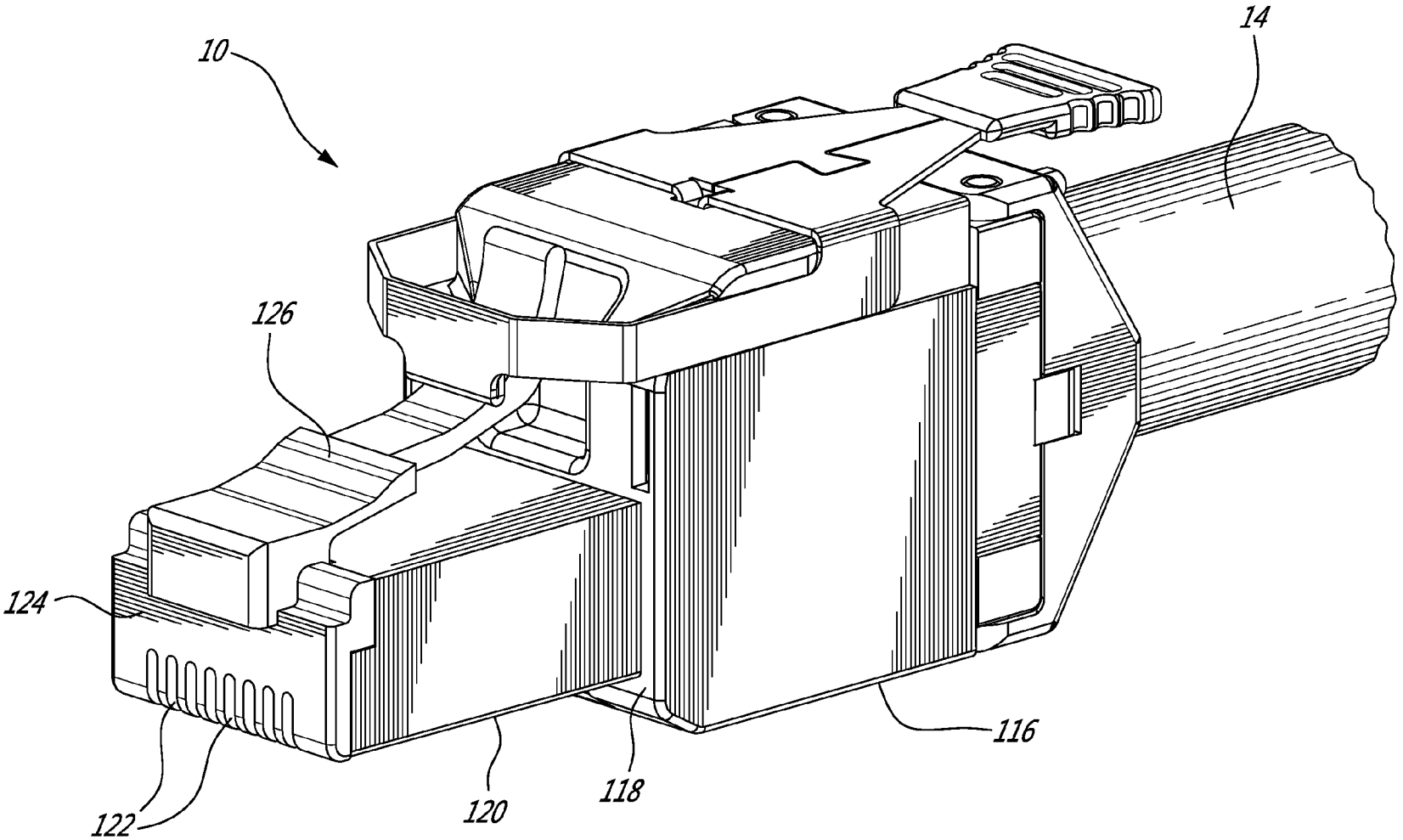
FIG. 7 provides a front perspective view of a plug type coupler connector and cable terminator in accordance with an alternative illustrative embodiment of the present invention.

Referring now to FIG. 7, in an alternative embodiment, the coupler connector and cable terminator 10 comprises a coupler connector 116 which terminates a cable 14 comprising a plurality of pairs of conductors (not shown). The coupler connector 116 comprises a forward surface 118 comprising a modular plug 120, such as an RJ-45 compatible plug, disposed thereon. The plug 120 further comprises a plurality terminal contacts 122 along a forward edge 124 thereof which are interconnected with respective conductors of the cable 14. When the plug is inserted into a socket (see for example reference 22 in FIG. 1), the terminal contacts 122 come into contact with respective ones of the contact strips/tines 28 exposed within the socket 22. The plug 120 further comprises a locking latch 126 which, when inserted into the socket 22, is received within the recess 34 and engages the shoulder 36 thereby retaining the plug 120 within the socket 22.

Figure 8:
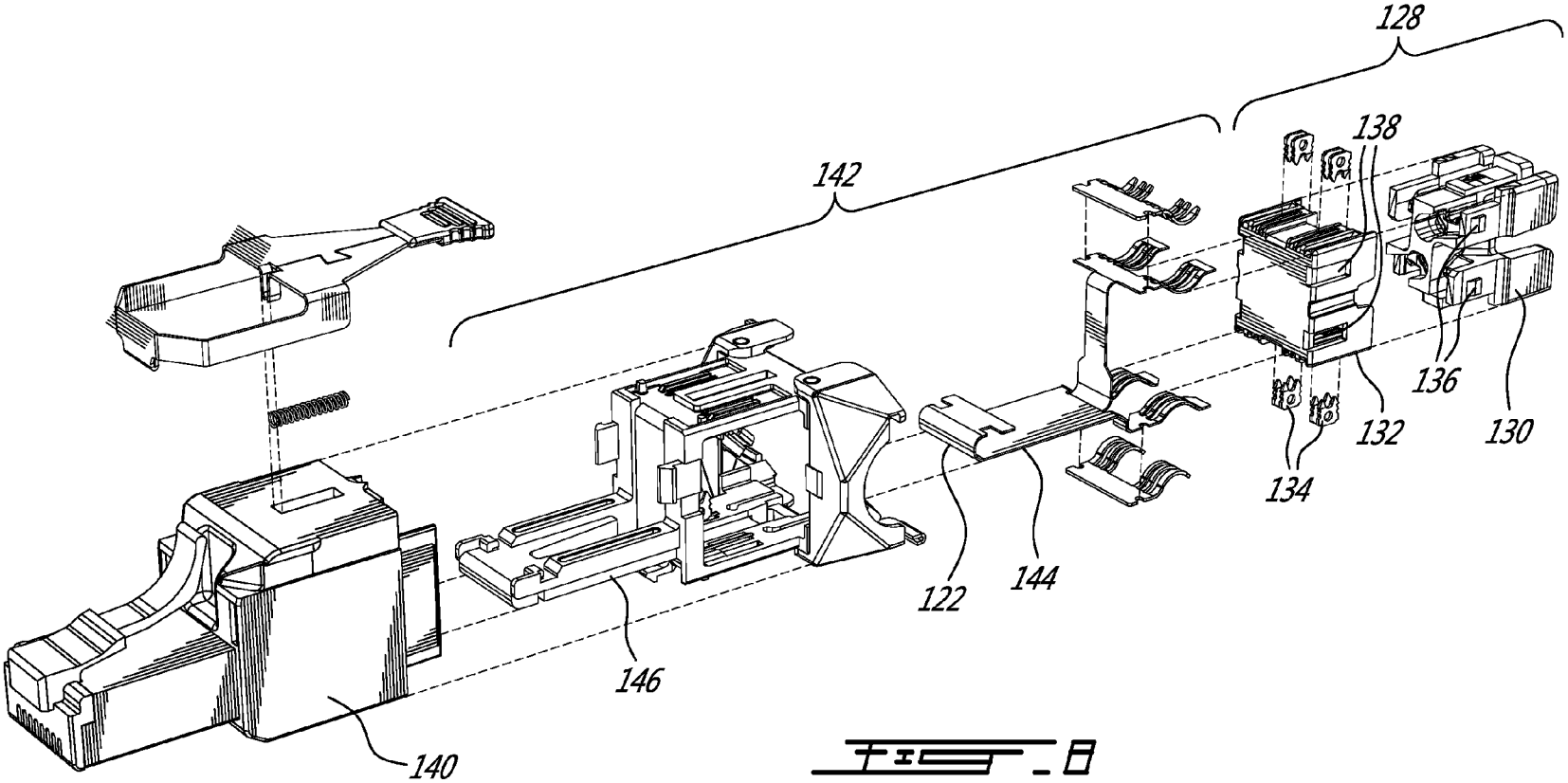
FIG. 8 provides an exploded perspective view of a plug type coupler connector and cable terminator in accordance with an alternative illustrative embodiment of the present invention.

Referring now to FIG. 8, in the alternative embodiment the coupler connector and cable terminator 10 further comprises a cable terminator 128 comprising a wire guide 130, cap 132 and a plurality of pairs of piercing contacts 134. During assembly, and as will be discussed in more detail below, the pairs of conductors of the cable 14 are first assembled to the wire guide 130, the cap 132 placed over the wire guide 130 wherein raised ribs 136 on the wire guide 130 are engaged in respective complementary recesses 138 machined or otherwise moulded into the cap 132, thereby securely retaining the cap 132 on the wire guide 130.

Still referring to FIG. 8, the coupler connector comprises an outer housing 140 which receives an interconnection assembly 142 comprising a flexible printed circuit board 144 onto which the plurality of terminal contacts 122 are etched, and a support 146.

Figure 9B:
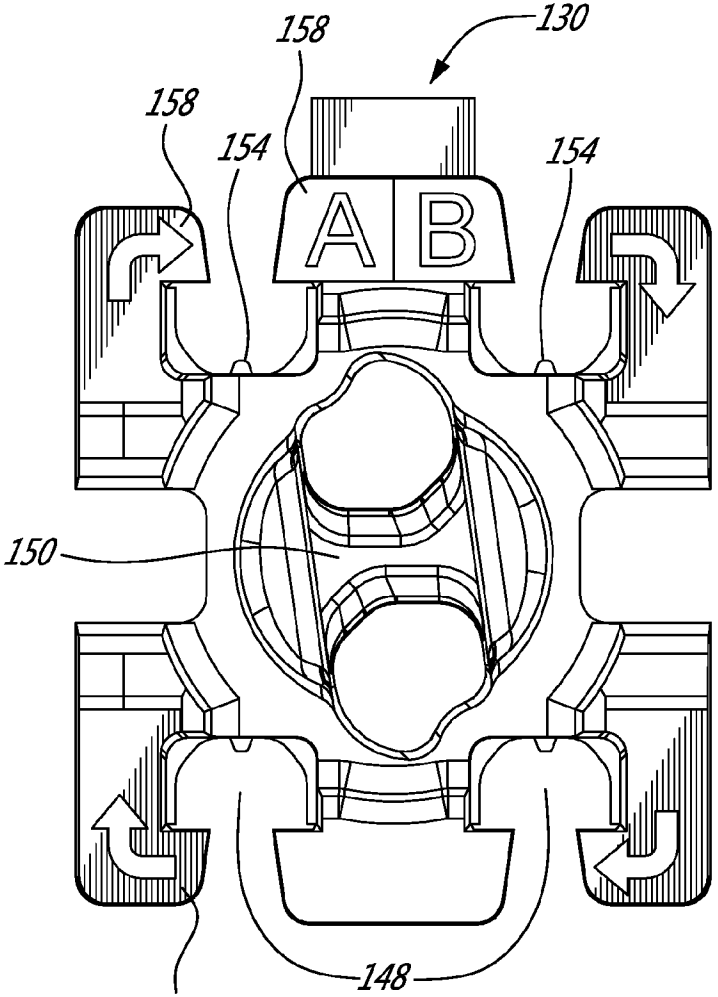
FIGS. 9A through 9D provide respectively perspective, bottom plan, side plan and top plan views of a wire guide in accordance with an alternative illustrative embodiment of the present invention.
Figure 9A:
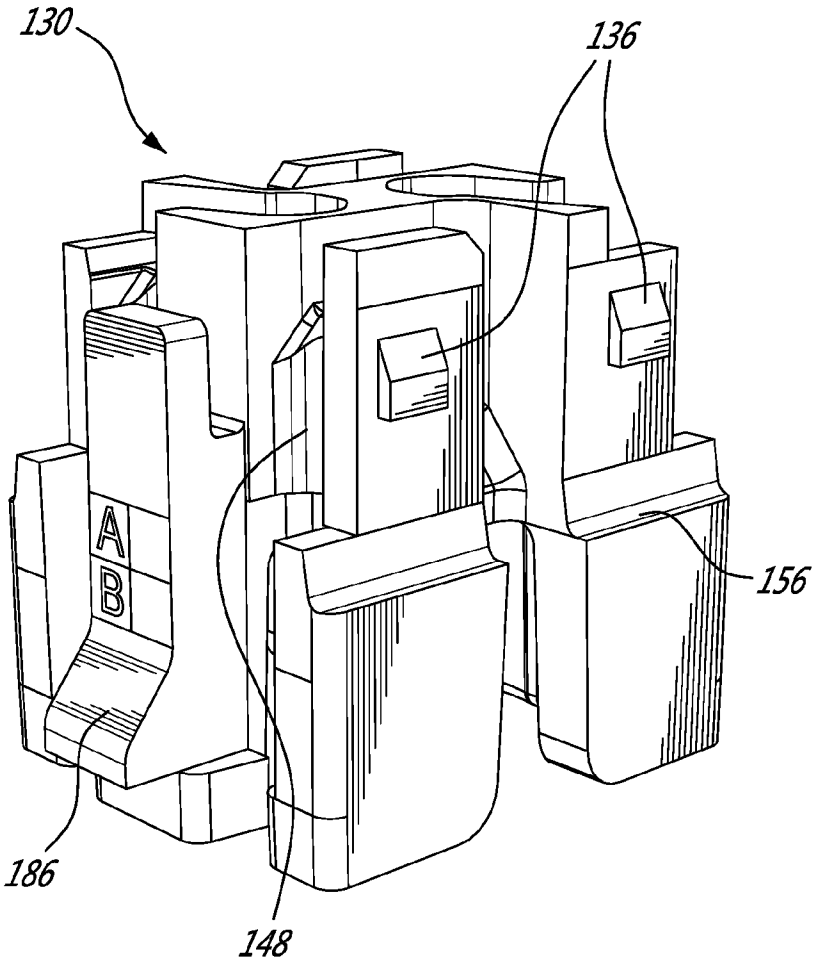
Figure 9D:
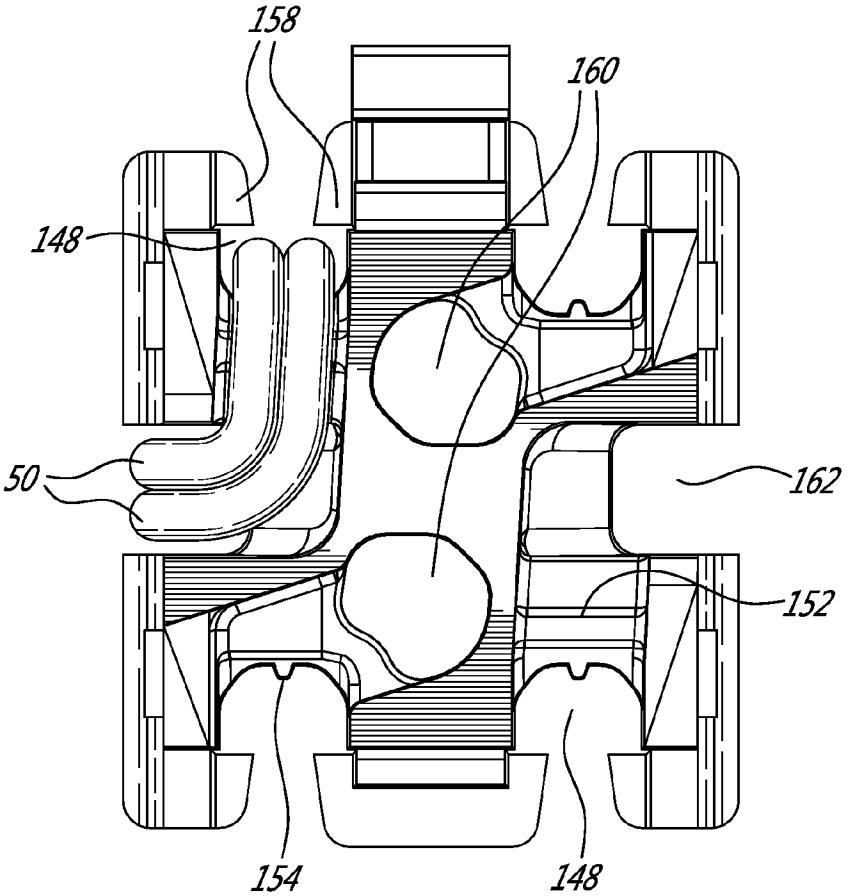
Figure 9C:
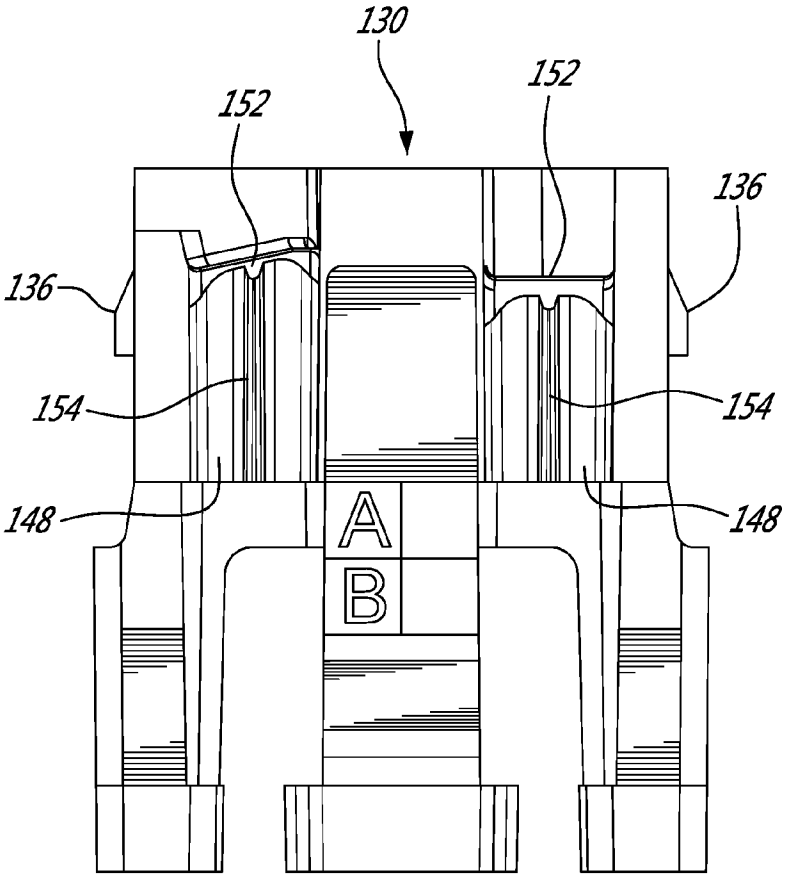

Referring now to FIGS. 9A, 9B and 9C, in the alternative embodiment, the wire guide 130 is fabricated from moulded plastic or the like and comprises a plurality of slots 148 arranged in parallel and on either side of a cable receiving region 150. Referring to FIG. 9B in particular, the cable receiving region 150 is substantially cylindrical, and concentric with the centre of the wire guide 130. The top edge 152 of each of the slots 148 is rounded to provide a shoulder around which, as will be discussed in more detail below, can be bent and retained. Two slots 148 are provided on either side of the cable receiving region 150 and exposed outwards. Each of the slots 148 comprises a slot dividing ridge 154 serves to better retain the pair of conductors (not shown) within the slot 148. A cap receiving ledge 156 is positioned about halfway down the wire guide 130. Protrusions 158 are provided at the bottom of the wire guide 130 providing a pair of opposed shoulders which may serve to hold the conductor pair within their respective slots 130 during assembly. Additionally, as discussed above, the out surface of the wire guide 130 comprises raised ribs 136 which engage in respective complementary recesses (reference 138 in FIG. 8) when the cap is installed on the wire guide 130.

Referring now to FIG. 9D, during assembly the end of the cable 14 is first stripped to remove the outer jacket and expose an end portion of the four pairs of conductors 50, which are typically twisted pairs of conductors. Each pair of conductors is straightened. The ends are threaded through a respective one of two inner holes 160 or two outer guides 162 moulded or otherwise formed in the wire guide 130. The conductor ends 50 are then unwound, pulled over the rounded top edge 152 and placed snuggly into their respective slots 148 where they are illustratively held temporarily in place by the protrusions 158. As discussed above, parallel align of the conductors 50 in their respective slots is aided by the slot dividing ridge 154. An advantage of this configuration is that the strain relief is increased as the mechanical strength of the interconnection between the cable 14 and the wire guide 130 is relatively strong, thereby decreasing, for example, that the cable 14 is inadvertently removed from the wire guide 130, for example by tugging on the cable 14 when installed.

Still referring to FIG. 9D, typically the conductors 50 are colour coded and arranged according to a standard configuration. In a particular embodiment each of the slots is identified with a unique colour code (not shown) thereby providing a visual key to the installer and simplifying installation.

Figure 10B:
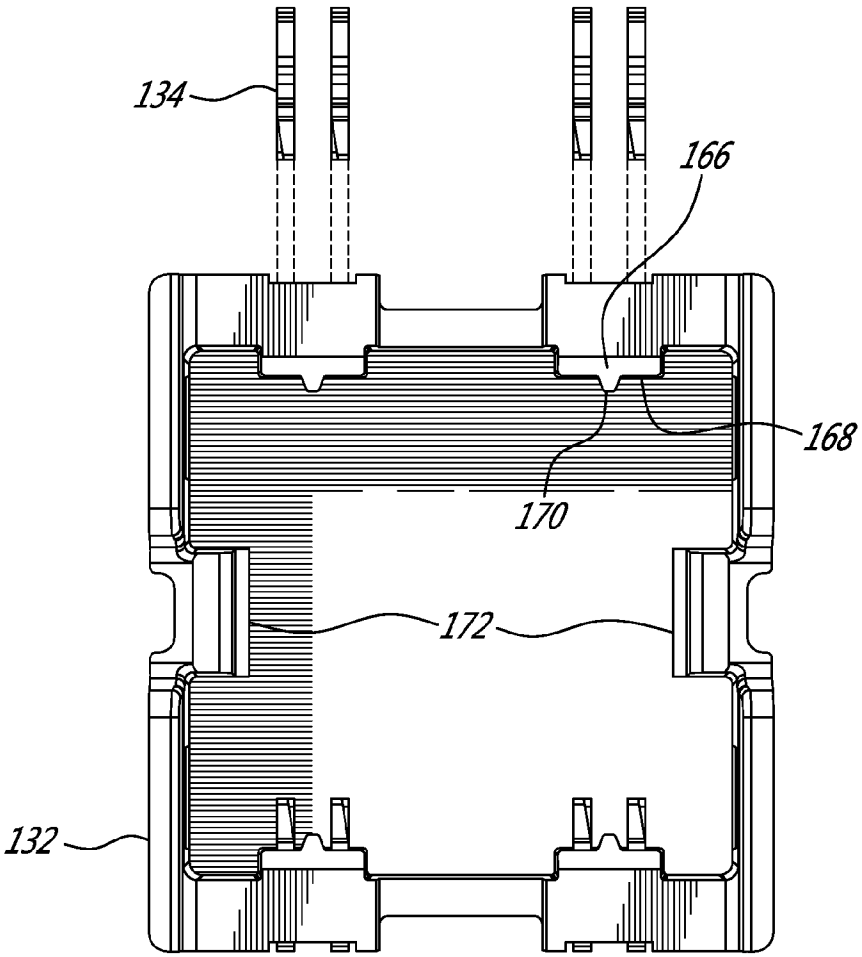
FIGS. 10A and 10B provide respectively top perspective and bottom plan views of a securing cap in accordance with an alternative illustrative embodiment of the present invention.
Figure 10A:
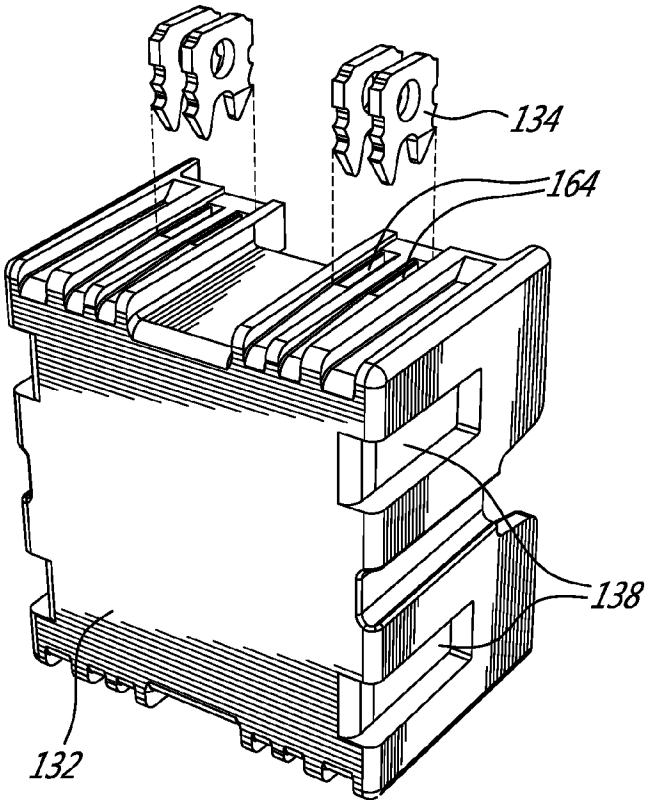

Referring to FIGS. 10A and 10B, the cap 132 is hollow and comprises four pairs of (8) piercing contact slots 164 therein which receive the pairs of piercing contacts 134. Aligned with each of the pairs of piercing contact slots 164 is a raised elongate boss 166 comprising a flat surface 168 divided by a raised ridge 170. On insertion of the wire guide 130 into the cap 132, each raised elongate boss 166 aligns with its respective slot (reference 148 in FIG. 9D, for example) and presses against the outside of the untwisted ends of their respective pair of conductors 50, ensuring that the untwisted ends are held securely and in parallel within their respective slots.

Still referring to FIGS. 10A and 10B a person of skill in the art will now understand that the piercing contacts 134, though initially not extending past the flat surface 168 prior to installation, are subsequently forced into their respective conductors 50 typically using a tool (not shown) once the cap 132 has been installed over the wire guide 130/cable 14 assembly. As discussed above, the cap 132 comprises recesses 138 which engage with complementary ribs 136 on the wire guide 130 for securing the cap 132 to the wire guide 130/cable 14 assembly. Additionally, guides 172 along the inside of the cap 132 are received between the ends of the wire guide 130, thereby closing the side access to the wire guide 130 and improving mechanical strength and stability of the assembly. In a particular embodiment the guides 172 are slightly tapered to provide a friction fit with the wire guide 130. Following installation of the cap 132 over the wire guide 130/cable 14 assembly and insertion of the piercing contacts 134 into their respective conductors 50, the outer edges of the piercing contacts 134 are flush with an outer surface of the cap 132 or slightly recessed within their respective piercing contact slots 164.

Figure 11:
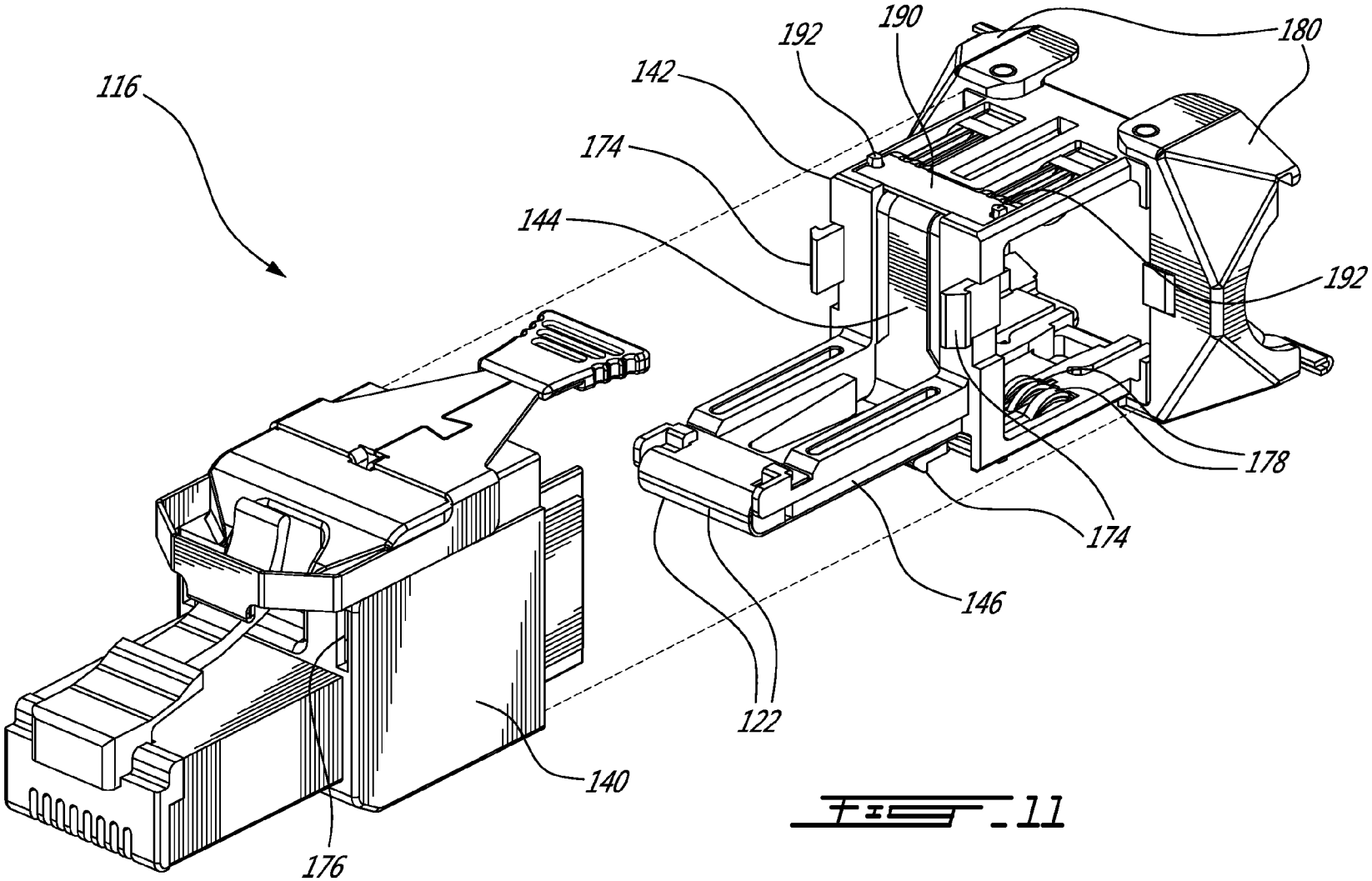
FIG. 11 provides a partially exploded front perspective view of a plug type coupler connector in accordance with an alternative illustrative embodiment of the present invention.

Referring now to FIG. 11 in addition FIG. 8, as discussed above in an alternative embodiment the coupler connector 116 comprises an outer housing 140 which receives an interconnection assembly 142 comprising a flexible printed circuit board (PCB) 144 onto which the plurality of terminal contacts 122 are etched, and a support 146. The support 146 is retained within the housing 140 by a plurality of tabs 174 which engage reciprocal slots 176 moulded or otherwise formed in the housing 140. The PCB 144 further comprises a plurality of contacting strips 178 comprising traces on a surface thereof which engage respective ones of the piercing contacts 134 when the cable terminator 128 is inserted into the coupler connector 116. The coupler connector 116 further comprises a pair of opposing doors 180 which are mounted on the support 146 to pivot about a respective axis.

Figure 12:
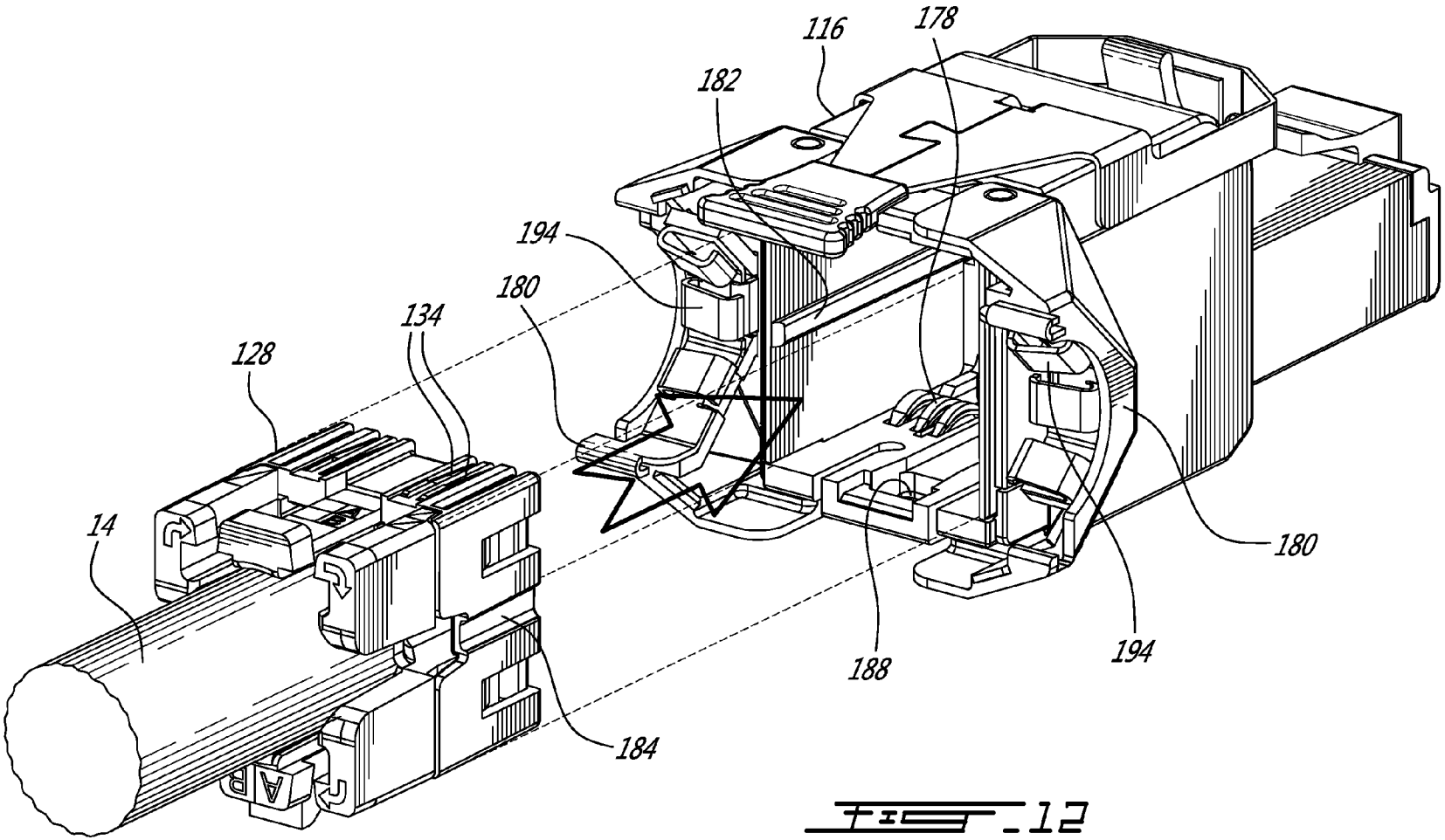
FIG. 12 provides a partially exploded rear perspective view of a plug type coupler connector during assembly and in accordance with an alternative illustrative embodiment of the present invention.

Referring now to FIG. 12, the assembled cable terminator 128 is inserted into the coupler connector 116 by first ensuring that the doors 180 are pivoted outwards. This opens the rearward surface of the coupler connector 116 allowing insertion of the cable terminator 128 into the coupler connector 116 as indicated. The coupler connector 116 is guided during insertion by a pair of opposing guides 182 which engaged corresponding guide slots 184 in the cable terminator 128. With reference to FIG. 9A in addition to FIG. 12, on full insertion of the cable terminator 128 into the coupler connector 116 a raised boss 186 on the wire guide 130 engages a corresponding flexible locking tab 188 in the housing 140 thereby securing the cable terminator 128 within the coupler connector 116. A person of ordinary skill in the art will now understand that, on complete insertion of the cable terminator 128 into the coupler connector 116 each of the contacting strips 178 comes into contact with respective ones of the piercing contacts 134 thereby completing the interconnection between the conductors of the cable 50 and the terminal contacts 122. Referring back to FIG. 8, contact between the contacting strips 178 and their respective piercing contacts 134 is maintained by comb like plastic spring 190 each which is held in place by a pair of pins 192 on the support 146 and wherein comb fingers bias respective ones of the contacting strips 178 towards their respective piercing contacts 134.

Figure 13:
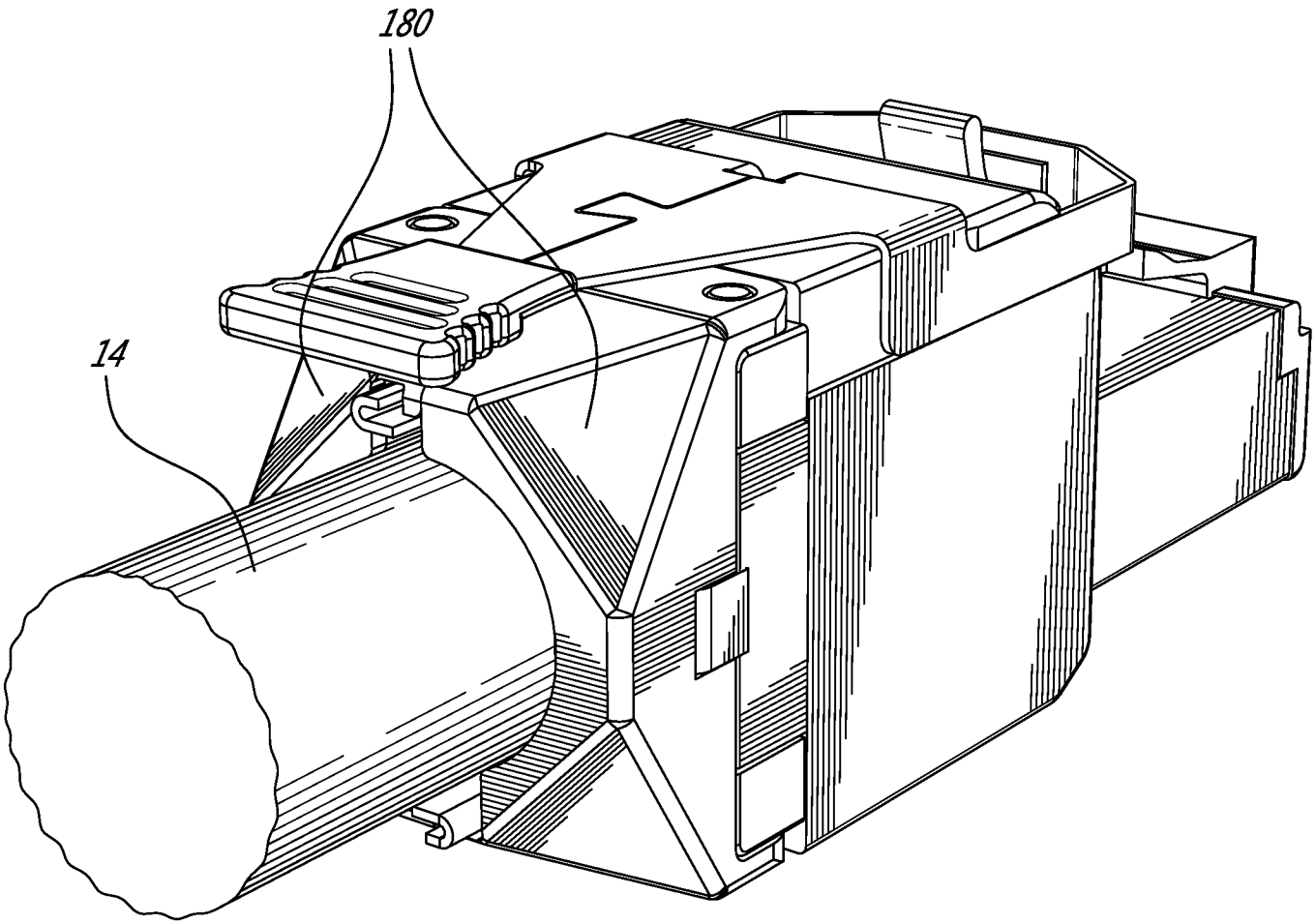
FIG. 13 provides a rear perspective view of an assembled plug type coupler connector in accordance with an alternative illustrative embodiment of the present invention.

Referring now to FIG. 13 in addition to FIG. 12, once the cable terminator 128 has been inserted completely into the coupler connector 116 the opposing doors 180 are shut and locked together. In this regard, the inside of each of the doors 180 comprises a gripping structure 194, manufactured from a flexible material such as steel or the like which engage the outer jacket of the cable 14 thereby improving mechanical strength.

Figure 14:
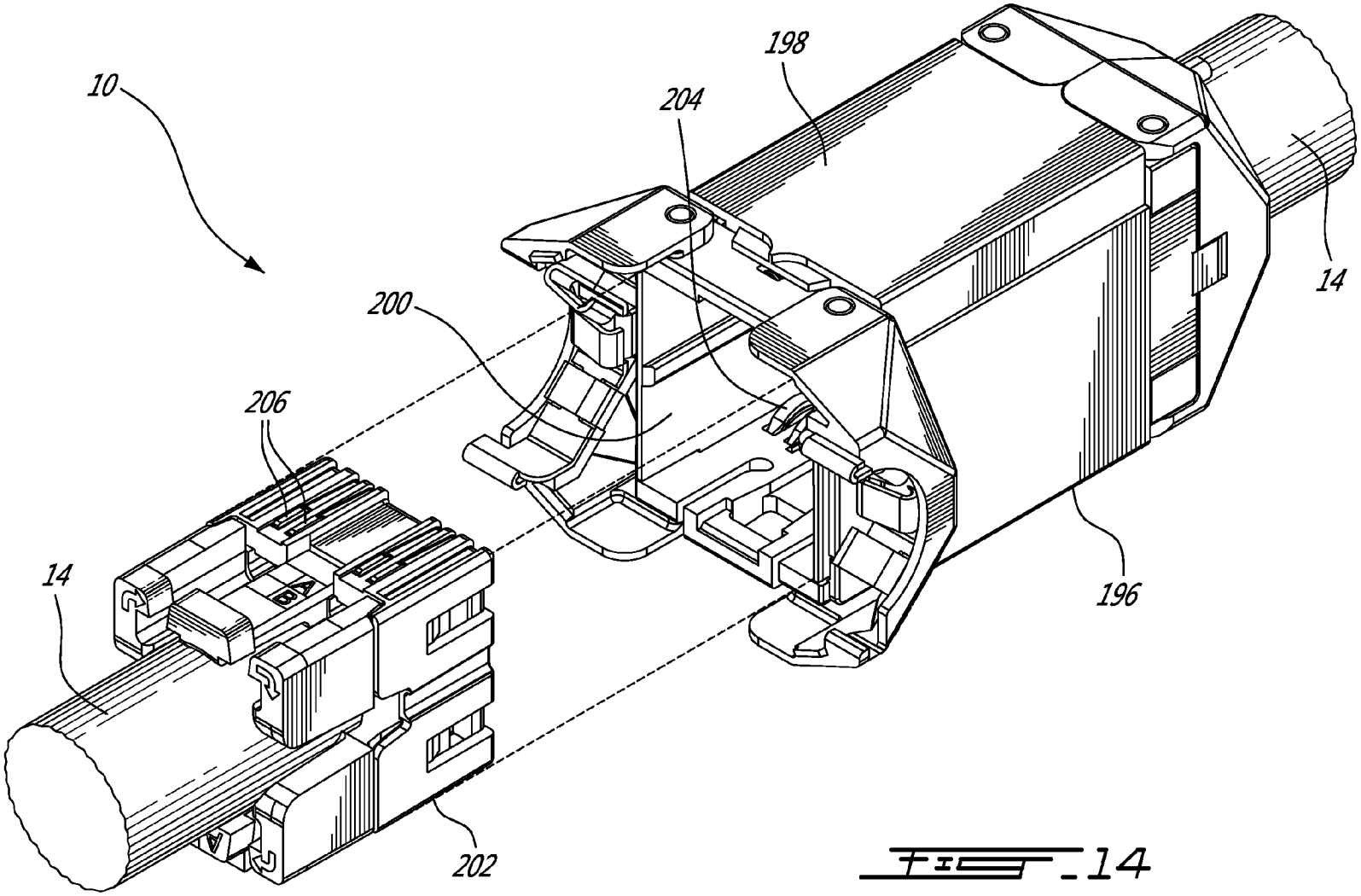
FIG. 14 provides an isometric view of a back-to-back coupler connector and cable terminators in accordance with a second illustrative embodiment of the present invention.

Referring now to FIG. 14, in a second alternative back-to-back embodiment of the coupler connector and cable terminator 10, the coupler connector 196 comprises a housing 198 comprising a pair of opposing cable terminator receiving inner surfaces 200 which are configured for receiving a respective one of a pair of cable terminators 202 each terminating a respective cable 14. In this regard the cable terminators 202 are illustratively the same as those of the alternative embodiment (reference 128) and as shown in FIGS. 9A through 9D and 10A and 10B. Contacting strips 204 are disposed along the inner surfaces 198 which interconnect with respective ones of the piercing contacts 206 when the cable terminators 200 are inserted into their respective inner surfaces 198. The coupler connector further comprises interconnections (not shown) between contacting strips 204 disposed within a first of the inner surfaces 198 and contacting strips 204 disposed within a second of the inner surfaces 198. As will now be understood by a person of ordinary skill in the art, insertion of a cable terminator 202/cable 14 assembly into respective ones of the inner surfaces 198 brings the conductors (not shown) of a first of the cables 14 into contact with respective conductors of a second of the cables 14.

Although the present invention has been described hereinabove by way of specific embodiments thereof, it can be modified, without departing from the spirit and nature of the subject invention as defined in the appended claims.

We claim:

1. An assembly for terminating a cable comprising a four pairs of conductors, the assembly comprising:

a cable terminator comprising:

a wire guide comprising two opposite outer sides and four elongate parallel conductor pair receiving slots, two of said slots exposed side by side on each of said two opposite outer sides, each of said slots for receiving a respective conductor pair;

a securing cap comprising an open end sized for snug installation at least partially over said wire guide opposite outer sides, a pair of opposed sidewalls each comprising two pairs of piercing contact receiving slots therein, and four pairs of piercing contacts, each of said pairs of piercing contacts insertable into a respective pair of said piercing contact receiving slots, wherein when assembled each of said opposed sidewalls is positioned adjacent a respective one of said opposite outer sides such that a piercing end of each of said piercing contacts is positioned opposite a respective one of said conductors and in contact with said respective conductor and an outer end of each of said piercing contacts is exposed on an outer surface of a respective securing cap sidewall; and a coupler connector comprising a rearward surface comprising a cable terminator receiving socket disposed therein wherein four pairs of socket contacts are exposed along at least one side wall of said socket and a forward surface comprising one of a modular socket disposed therein, wherein a plurality of tines are exposed within said modular socket wherein each of said is interconnected with a respective one of said socket contacts and a plug disposed thereon, wherein a plurality of terminal contacts are exposed along a forward edge of said plug and each of said terminal contacts is interconnected with a respective one of said socket contacts;

wherein when said cable terminator is inserted into said cable terminator receiving socket, each of said piercing contacts comes into contact with a respective one of said socket contacts, thereby interconnecting each of said tines with a respective one of the conductors.

2. The assembly of claim 1, wherein said modular socket is an RJ-45 compatible socket and said plurality of tines comprises eight tines.

3. The assembly of claim 1, wherein said modular plug is an RJ-45 compatible plug and said plurality of terminal contacts comprises eight terminal contacts.

4. The assembly of claim 1, further comprising a snap fit interconnecting said wire guide and said securing cap.

5. The assembly of claim 4, wherein said snap fit comprises a plurality of raised ribs on said wire guide and a corresponding plurality of recesses in said securing cap, each of said recesses for engaging a respective one of said ribs when assembled.

6. The assembly of claim 1, wherein said elongate member is received in a slot in said securing cap.

7. The assembly of claim 1, wherein said wire guide comprises a pair of plates each comprising a forward edge and arranged on either side of an axis and generally in parallel to and opposite one another, an elongate member at right angles to said axis and rigidly secured at either end to a point of attachment at a respective middle of each of said forward edges, each of said plates further comprising an inner surface which together define a cable receiving region arranged about said axis there between, a pair of notches on said forward edge wherein one of each of said notches is positioned on either side of said points of attachment, and a pair said slots on an outer surface thereof, each of said slots arranged in parallel to said axis and intersecting a respective one of said notches.

8. The assembly of claim 7, wherein said inner surface is arcuate and said cable receiving region is substantially cylindrical.

9. The assembly of claim 7, wherein said pair of plates flex about their respective points of attachment and further wherein when assembled, a free end of a first of said plates is biased towards a free end of a second of said plates and such that the cable is gripped there between.

10. A back-to-back connector assembly for interconnecting a first multi conductor cable with a second multi conductor cable, the connector comprising:

a pair of cable terminators for terminating respective ones of the cables, one of said each of said cable terminators comprising:

a wire guide comprising two opposite outer sides and four elongate parallel conductor pair receiving slots, two of said slots exposed side by side on each of said two opposite outer sides, each of said slots for receiving a respective conductor pair;

a securing cap comprising an open end sized for snug installation at least partially over said wire guide opposite outer sides, a pair of opposed sidewalls each comprising two pairs of piercing contact receiving slots therein, and four pairs of piercing contacts, each of said pairs of piercing contacts insertable into a respective pair of said piercing contact receiving slots, wherein when assembled each of said opposed sidewalls is positioned adjacent a respective one of said opposite outer sides such that a piercing end of each of said piercing contacts is positioned opposite a respective one of said conductors and in contact with said respective conductor and an outer end of each of said piercing contacts is exposed on an outer surface of a respective securing cap sidewall; and a coupler connector comprising a rearward surface comprising a first cable terminator receiving socket disposed therein wherein a first plurality of pairs of socket contacts are exposed along at least one side wall of said first socket and a forward surface comprising a second cable terminator receiving socket disposed therein wherein a second plurality of pairs of socket contacts are exposed along at least one side wall of said second, and further wherein each of said first plurality of socket contacts is interconnected with a respective one of said second plurality of socket contacts;

wherein when said cable terminators are inserted into their respective cable terminator receiving sockets, each of said piercing contacts comes into contact with a respective one of said socket contacts, thereby interconnecting conductors of the first multi-conductor cable with conductors of the second multi-conductor cable.

11. The back-to-back connector assembly of claim 10, wherein each of the cables comprises four twisted pairs of conductors.

12. A method for terminating a cable comprising a jacket surrounding a plurality of twisted pairs of conductors, the method comprising:

stripping a length of the jacket from an end of the cable to expose a free end of each of said pairs of conductors;

feeding said free ends though the middle of a wire guide in a first direction;

untwisting at least a portion of said free ends;

bending each the untwisted free ends over said wire guide into a respective receiving slot and in a direction opposite said first direction wherein the untwisted free end of the first pair and second pair of the conductors are exposed along a first side of said wire guide and the untwisted free end of the third pair and fourth pair of the conductors is exposed along a second side of said wire guide opposite said first side;

inserting said wire guide into an open end of a securing cap comprising a plurality of pairs of piercing contacts arranged along opposite sides thereof, wherein when said securing cap is installed on said wire guide, each of said pairs of piercing contacts align with a respective pair of conductors;

piercing an insulation of each of said conductors with a piercing first end of an aligned one of said piercing contacts wherein a contacting second end of each of said piercing contacts remains exposed on an outer surface of said cap;

inserting said cap and said wire guide into a cap and wire guide receiving socket in rearward surface of a coupler connector such that each of said contacting second ends of said piercing contacts comes into contact with a respective one of eight socket contacts exposed on an inside wall of said cap and wire guide receiving socket, said coupler connector further comprising a forward surface comprising one of a modular socket and disposed therein, wherein a plurality of tines are exposed within said modular socket and each of said tines is interconnected with a respective one of said socket contacts and a modular plug disposed thereon, wherein a plurality of terminal contacts are exposed along a forward edge of said plug and each of said terminal contacts is interconnected with a respective one of said socket contacts.

13. The method for terminating a cable of claim 12, wherein the plurality of conductors comprises first, second, third and fourth twisted pairs of conductors and said modular socket is an RJ-45 compatible socket and said plurality of tines comprises eight tines.

14. The method for terminating a cable of claim 12, wherein the plurality of conductors comprises first, second, third and fourth twisted pairs of conductors and said modular plug is an RJ-45 compatible plug and said plurality of terminal contacts comprises eight terminal contacts.

* * * * *